US010808968B2

(12) United States Patent
Saito et al.

(10) Patent No.: US 10,808,968 B2
(45) Date of Patent: Oct. 20, 2020

(54) THERMOACOUSTIC COOLING DEVICE

(71) Applicants: JTEKT CORPORATION, Osaka-shi, Osaka (JP); PUBLIC UNIVERSITY CORPORATION OSAKA CITY UNIVERSITY, Osaka-shi, Osaka (JP)

(72) Inventors: Toshiyuki Saito, Kashiba (JP); Ryouichi Takahata, Kitakatsuragi-gun (JP); Tomoyuki Takei, Nara (JP); Osamu Ishikawa, Osaka (JP)

(73) Assignees: JTEKT CORPORATION, Osaka (JP); PUBLIC UNIVERSITY CORPORATION OSAKA CITY UNIVERSITY, Osaka (JP)

( * ) Notice: Subject to any disclaimer, the term of this patent is extended or adjusted under 35 U.S.C. 154(b) by 228 days.

(21) Appl. No.: 15/671,688

(22) Filed: Aug. 8, 2017

(65) Prior Publication Data

US 2018/0045435 A1 Feb. 15, 2018

(30) Foreign Application Priority Data

Aug. 9, 2016 (JP) ..... 2016-156725

(51) Int. Cl.
*F25B 9/14* (2006.01)

(52) U.S. Cl.
CPC ..... *F25B 9/145* (2013.01); *F25B 2309/1403* (2013.01)

(58) Field of Classification Search
CPC ..... H01M 8/04007; F25B 9/145; F25B 2309/1403
See application file for complete search history.

(56) References Cited

U.S. PATENT DOCUMENTS

2006/0185370 A1* 8/2006 Watanabe ..... F25B 9/145 62/6

FOREIGN PATENT DOCUMENTS

| | | | |
|---|---|---|---|
| CN | 1761846 | A | 4/2006 |
| JP | 2007-147192 | A | 6/2007 |
| JP | 2008-101910 | A | 5/2008 |

OTHER PUBLICATIONS

U.S. Pub. No. 2006/0185370 cited in Jan. 10, 2020 Office Action. Apr. 14, 2020 Office Action issued in Chinese Patent Application No. 201710674641.9.

* cited by examiner

*Primary Examiner* — Ula C Ruddock
*Assistant Examiner* — Frank A Chernow
(74) *Attorney, Agent, or Firm* — Oliff PLC

(57) ABSTRACT

A thermoacoustic cooling device includes a tube in which a working fluid is enclosed; a first stack that generates acoustic waves in the working fluid with use of a temperature gradient; a first high-temperature heat exchanger provided at a first side of the first stack to heat the first side of the first stack; a first low-temperature heat exchanger provided at a second side of the first stack; a second stack in which a temperature gradient is generated by the acoustic waves; a second high-temperature heat exchanger provided at a first side of the second stack, which has a high temperature; a second low-temperature heat exchanger provided at a second side of the second stack, which has a low temperature; and a heat transfer portion configured to connect the second low-temperature heat exchanger to the first low-temperature heat exchanger so as to transfer heat therebetween.

6 Claims, 4 Drawing Sheets

THERMOACOUSTIC COOLING DEVICE

INCORPORATION BY REFERENCE

The disclosure of Japanese Patent Application No. 2016-156725 filed on Aug. 9, 2016 including the specification, drawings and abstract is incorporated herein by reference in its entirety.

BACKGROUND

1. Technical Field

The disclosure relates to a thermoacoustic cooling device that uses conversion between thermal energy and sound energy.

2. Description of Related Art

Recently, there has been proposed a thermoacoustic cooling device using a thermoacoustic effect, which is a conversion phenomenon between thermal energy and sound energy. For example, Japanese Patent Application Publication No. 2008-101910 (JP 2008-101910 A) describes a thermoacoustic device in which a first stack and a second stack are disposed inside a looped tube. The first stack is sandwiched between a first high-temperature heat exchanger and a first low-temperature heat exchanger. The second stack is sandwiched between a second high-temperature heat exchanger and a second low-temperature heat exchanger. In the thermoacoustic device, self-excited acoustic waves are generated by generating a temperature gradient in the first stack. The second low-temperature heat exchanger can be cooled by the acoustic waves.

JP 2008-101910 A describes that a length of the looped tube, a state of a working fluid enclosed in the looped tube, and diameters of conduction paths in the first stack and the second stack are set appropriately, so as to improve efficiency of heat exchange in the stacks.

SUMMARY

In the thermoacoustic device in the related art, when the temperature gradient of the first stack exceeds a critical point, acoustic waves are generated. In order to cool the low-temperature heat exchanger of the second stack to a desired temperature, a temperature of the high-temperature heat exchanger of the first stack may be required to be further increased so that the temperature gradient is made larger than the critical point. That is, in the thermoacoustic cooling device, a temperature required to operate the thermoacoustic cooling device tends to be high.

The present application discloses a thermoacoustic cooling device that can decrease a temperature required to operate the thermoacoustic cooling device.

A thermoacoustic cooling device according to an aspect of the disclosure includes a tube which includes at least one looped tube, and in which a working fluid is enclosed; a first stack that is provided inside the tube and generates acoustic waves in the working fluid in the tube with use of a temperature gradient in the first stack; a first high-temperature heat exchanger provided at a first side of the first stack and configured to heat the first side of the first stack with use of heat from an outside of the tube; a first low-temperature heat exchanger provided at a second side of the first stack and configured to make a temperature of the second side of the first stack lower than a temperature of the first side of the first stack; a second stack which is provided inside the tube, and in which a temperature gradient is generated in the second stack by the acoustic waves of the working fluid in the tube; a second high-temperature heat exchanger provided at a first side of the second stack, the first side of the second stack having a high temperature at a time when the temperature gradient is generated in the second stack; a second low-temperature heat exchanger provided at a second side of the second stack, the second side of the second stack having a low temperature at the time when the temperature gradient is generated in the second stack; and a heat transfer portion configured to connect the second low-temperature heat exchanger to the first low-temperature heat exchanger so as to transfer heat between the second low-temperature heat exchanger and the first low-temperature heat exchanger.

According to the disclosure of the present application, an operating temperature of the thermoacoustic cooling device can be decreased.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
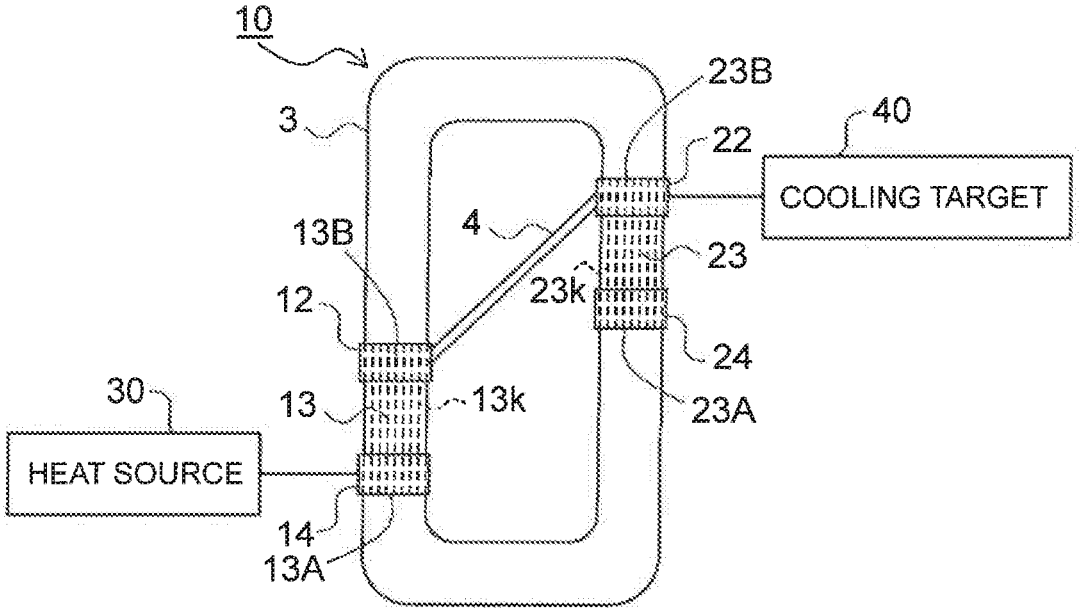
FIG. 1 is a view illustrating an example configuration of a thermoacoustic cooling device in a first embodiment.

A thermoacoustic cooling device according to an embodiment of the disclosure includes a tube which includes at least one looped tube, and in which a working fluid is enclosed; a first stack that is provided inside the tube and generates acoustic waves in the working fluid in the tube with use of a temperature gradient in the first stack; a first high-temperature heat exchanger provided at a first side of the first stack and configured to heat the first side of the first stack with use of heat from an outside of the tube; a first low-temperature heat exchanger provided at a second side of the first stack and configured to make a temperature of the second side of the first stack lower than a temperature of the first side of the first stack; a second stack which is provided inside the tube, and in which a temperature gradient is generated in the second stack by the acoustic waves of the working fluid in the tube; a second high-temperature heat exchanger provided at a first side of the second stack, the first side of the second stack having a high temperature at a time when the temperature gradient is generated in the second stack; a second low-temperature heat exchanger provided at a second side of the second stack, the second side of the second stack having a low temperature when the temperature gradient is generated in the second stack; and a heat transfer portion configured to connect the second low-temperature heat exchanger to the first low-temperature heat exchanger so as to transfer heat between the second low-temperature heat exchanger and the first low-temperature heat exchanger (a first configuration).

In the first configuration, the temperature of the first high-temperature heat exchanger of the first stack is increased by heat of the outside of the tube, and the temperature of the first low-temperature heat exchanger is kept lower than the temperature of the first high-temperature heat exchanger, and thus, the temperature gradient is generated in the first stack. Acoustic waves are generated in the working fluid inside the tube by the temperature gradient in the first stack. The acoustic waves generate, in the second stack, a temperature gradient corresponding to the temperature gradient of the first stack. The second high-temperature heat exchanger can control the temperature of the high-temperature side of the second stack (i.e., the first side having a high temperature) at the time when the temperature gradient is generated in the second stack. The temperature at the low-temperature side (i.e., the second side) of the second stack can he made lower than the controlled temperature at the high-temperature side of the second stack. When heat exchange is performed between the low-temperature side of the second stack and the outside of the tube via the second low-temperature heat exchanger, the outside of the tube is cooled. Further, the second low-temperature heat exchanger is connected to the first low-temperature heat exchanger by the heat transfer portion such that heat can be transferred between the second low-temperature heat exchanger and the first low-temperature heat exchanger. Accordingly, due to a decrease in the temperature of the second low-temperature heat exchanger, the temperature of the first low-temperature heat exchanger also decreases. Thus, the temperature gradient in the first stack becomes larger. That is, the temperature gradient in the first stack can be made larger without increasing the temperature of the first high-temperature heat exchanger. This accordingly makes it possible to decrease a required temperature at the high-temperature side (i.e., the first side) of the first stack, that is, a temperature required to obtain a desired cooling function. That is, it is possible to decrease a temperature required to operate the thermoacoustic cooling device.

In the first configuration, the heat transfer portion may include a heat transfer tube through which a fluid flows between the second low-temperature heat exchanger and the first low-temperature heat exchanger (a second configuration). The heat can be transferred efficiently between the second low-temperature heat exchanger and the first low-temperature heat exchanger by the fluid flowing through the heat transfer tube.

In the second configuration, the heat transfer tube may be configured to cause the fluid to flow from the second low-temperature heat exchanger to the first low-temperature heat exchanger (a third configuration). In the third configuration, the fluid cooled by the second low-temperature heat exchanger can be moved to the first low-temperature heat exchanger. Therefore, the first low-temperature heat exchanger can be cooled efficiently.

In the first configuration, the heat transfer portion may include a metal heat transfer body that connects the second low-temperature heat exchanger to the first low-temperature heat exchanger (a fourth configuration). This makes it possible to simplify the configuration of the heat transfer portion.

In any of the first to the fourth configurations, the thermoacoustic cooling device may further include a cooler configured to cool the second high-temperature heat exchanger (a fifth configuration). By cooling the second high-temperature heat exchanger with the use of the cooler, the temperature of the second low-temperature heat exchanger can be further decreased when the thermoacoustic cooling device operates. Thus, the temperature gradient in the first stack can be made larger.

The embodiment will be described with reference to the drawings. The same reference numeral is assigned to the same and equivalent constituents in the figures, and the same description is not repeated. For the convenience of description, in each of the figures, a configuration may be illustrated simply or schematically, or the configuration may be partially omitted.

First Embodiment

FIG. 1 is a view illustrating an example configuration of a thermoacoustic cooling device in a first embodiment. The thermoacoustic cooling device 10 includes a tube 3 including one looped tube, and a first stack 13 and a second stack 23 provided inside the tube 3. A working fluid is enclosed in the tube 3. The working fluid may be air, nitrogen, helium, argon or an air-fuel mixture including at least two of them, for example.

The first stack 13 includes a plurality of conduction paths 13*k* extending through the first stack 13 in a lengthwise direction (also referred to as an axial direction) of the tube 3. The second stack 23 includes a plurality of conduction paths 23*k* extending through the second stack 23 in the lengthwise direction of the tube 1 The conduction paths 13*k*, 23*k* are passages for the working fluid. That is, in the first stack 13 and the second stack 23, the working fluid can move inside the conduction paths 13*k*, 23*k*. The working fluid can pass through the first stack 13 and the second stack 23 in the lengthwise direction of the tube 3. Note that the stack can be also referred to as a heat accumulator.

When a temperature gradient inside the first stack 13 exceeds a critical point, the working fluid inside the stack 13 vibrates. When a temperature gradient inside the second stack 23 exceeds a critical point, the working fluid inside the stack 23 vibrates. The vibration of the working fluid generates acoustic waves. As a result, acoustic waves are generated in the working fluid inside the tube 3. Further, when the working fluid inside the first stack 13 or the second stack 23 vibrates due to the acoustic waves inside the tube 3, a temperature gradient is generated inside the first stack 13 or the second stack 23. The temperature gradient is generated between a first side (one end) 13A and a second side (the other end) 13B of the first stack 13 in a tube lengthwise direction. Similarly, a temperature gradient is generated between a first side (one end) 23A and a second side (the other end) 23B of the second stack 23 in the tube lengthwise direction. Thus, the first stack 13 and the second stack 23 can convert thermal energy to sound energy and vice versa. Note that, in the present specification, the first side (one end) of the stack indicates one end surface of the stack and a part inward of the one end surface, and the second side (the other end) of the stack indicates the other end surface of the stack and a part inward of the other end surface.

In the first stack 13 and the second stack 23, the conduction paths 13*k*, 23*k* may be formed by a plurality of walls extending in the lengthwise direction of the tube 3, for example. In this case, the plurality of walls may have, for example, a grid-shape in a section perpendicular to the lengthwise direction of the tube 3. In another example, each of the first stack 13 and the second stack 23 may be a columnar body extending in the lengthwise direction of the tube 3 and having a plurality of holes extending in the lengthwise direction. In yet another example, in each of the first stack 13 and the second stack 23, a plurality of hollow columns extending in the lengthwise direction of the tube 3 may be arranged. In this case, each of the columns has a hexagonal sectional shape perpendicular to the axial direction, and thus, the columns can be arranged without any gap. That is, each of the first stack 13 and the second stack 23 may have a honeycomb structure.

Each of the first stack 13 and the second stack 23 may be made of metal or ceramic, for example. The first stack 13 and the second stack 23 may have many conduction paths 13*k*, 23*k*, respectively. A sectional area of each of the conduction paths 13*k*, 23*k* may be sufficiently smaller than a sectional area of an inside of the tube 3, the sectional area of each of the conduction paths 13*k*, 23*k* and the sectional area of the inside of the tube 3 being perpendicular to the lengthwise direction of the tube 3. Note that the first stack 13 and the second stack 23 do not necessarily need to have the same configuration.

In the present embodiment, a temperature gradient is generated such that a temperature of the first side 13A of the first stack 13 is higher than a temperature of the second side 13B. Acoustic waves are generated in the tube 3 by the temperature gradient in the first stack 13. Due to the acoustic waves thus generated by the temperature gradient in the first stack 13, a temperature gradient is generated in the second stack 23.

A heat exchanger 14 is provided at the first side 13A of the first stack 13. and a heat exchanger 12 is provided at the second side 13B of the first stack 13. A heat exchanger 24 is provided at the first side 23A of the second stack 23, and a heat exchanger 22 is provided at the second side 23B of the second stack 23. Each of the heat exchangers 12, 22, 14, 24 performs heat exchange between an outside of the tube 3 and the first stack 13 or the second stack 23. When the thermoacoustic cooling device 10 operates, acoustic waves are generated in the tube 3, and a temperature gradient is generated between the first side 13A and the second side 13B of the first stack 13 and between the first side 23A and the second side 23B of the second stack 23. The heat exchanger 14 provided at the first side 13A of the first stack 13 is referred to as the "first high-temperature heat exchanger 14", the first side 13A having a high temperature due to the temperature gradient when the thermoacoustic cooling device 10 operates. The heat exchanger 12 provided at the second side 13B of the first stack 13 is referred to as the "first low-temperature heat exchanger 12", the second side 13B having a low temperature due to the temperature gradient when the thermoacoustic cooling device 10 operates. The heat exchanger 24 provided at the first side 23A of the second stack 23 is referred to as the "second high-temperature heat exchanger 24", the first side 23A having a high temperature due to the temperature gradient when the thermoacoustic cooling device 10 operates. The heat exchanger 22 provided at the second side 23B of the second stack 23 is referred to as the "second low-temperature heat exchanger 22", the second side 23B having a low temperature due to the temperature gradient when the thermoacoustic cooling device 10 operates. Note that the heat exchangers 14, 24, 12, 22 do not necessarily need to make contact with the first sides 13A, 23A and the second sides 13B, 23B of the stacks 13, 23.

The first high-temperature heat exchanger 14 is disposed on an outer peripheral surface of the tube 3 at a position corresponding to the first side 13A of the first stack 13. The first low-temperature heat exchanger 12 is disposed on the outer peripheral surface of the tube 3 at a position corresponding to the second side 13B of the first stack 13. The second high-temperature heat exchanger 24 is disposed on the outer peripheral surface of the tube 3 at a position corresponding to the first side 23A of the second stack 23. The second low-temperature heat exchanger 22 is disposed on the outer peripheral surface of the tube 3 at a position corresponding to the second side 23B of the second stack 23.

The first high-temperature heat exchanger 14 heats the first side 13A of the first stack 13 with the use of heat from the outside of the tube 3. The first high-temperature heat exchanger 14 is connected to an external heat source 30 such that heat can be transferred from the external heat source 30 to the first high-temperature heat exchanger 14. The heat of the heat source 30 reaches the first side 13A of the first stack 13 via the first high-temperature heat exchanger 14.

The first low-temperature heat exchanger 12 transfers heat between the outside of the tube 3 and the second side 13B of the first stack 13, so as to adjust the temperature of the second side 13B of the first stack 13. For example, the first low-temperature heat exchanger 12 can prevent the temperature of the second side 13B of the first stack 13 from becoming higher than a prescribed reference temperature. That is, with the use of the first high-temperature heat exchanger 14 and the first low-temperature heat exchanger 12, the temperature gradient (temperature difference) between the first side 13A and the second side 13B of the first stack 13 can be controlled.

The first low-temperature heat exchanger 12, the first stack 13 and the first high-temperature heat exchanger 14 constitute a thermoacoustic prime mover (a thermoacoustic engine) that generates acoustic waves by converting input heat into vibrations of the working fluid.

In the present embodiment, when the temperature gradient is generated in the second stack 23 by the acoustic waves thus generated by the temperature gradient in the first stack 13, the temperature of the second side 23B of the second stack 23 becomes lower than the temperature of the first side 23A. The second high-temperature heat exchanger 24 is provided at the first side 23A that has a high temperature at the time when the temperature gradient is generated inside the second stack 23 due to the temperature gradient in the first stack 13. The second low-temperature heat exchanger 22 is provided at the second side 23B that has a low temperature at the time when the temperature gradient is generated inside the second stack 23 due to the temperature gradient in the first stack 13.

The second high-temperature heat exchanger 24 transfers heat between the outside of the tube 3 and the first side 23A of the second stack 23, so as to adjust the temperature of the first side 23A of the second stack 23. For example, the second high-temperature heat exchanger 24 can maintain the temperature of the first side 23A of the second stack 23 at a prescribed temperature.

The second low-temperature heat exchanger 22 absorbs heat of the outside of the tube 3 and introduces the heat into the second side 23B of the second stack 23. Thus, the outside of the tube 3 is cooled. In other words, the second low-temperature heat exchanger 22 takes out cold energy of the second side 23B of the second stack 23 in which the temperature decreases due to the temperature gradient generated in the second stack 23, and transfers the cold energy to the outside of the tube 3. The second low-temperature heat exchanger 22 is connected to, for example, a cooling target 40 provided outside the tube 3 such that heat can be transferred between the second low-temperature heat exchanger 22 and the cooling target 40.

The second low-temperature heat exchanger 22, the second stack 23, and the second high-temperature heat exchanger 24 constitute a thermoacoustic heat pump that generates a temperature gradient from acoustic waves (vibrations of the working fluid).

The thermoacoustic cooling device 10 includes a heat transfer portion 4 that connects the second low-temperature heat exchanger 22 to the first low-temperature heat exchanger 12 such that heat can be transferred therebetween. That is, the heat transfer portion 4 transfers heat between the second low-temperature heat exchanger 22 and the first low-temperature heat exchanger 12. With the use of the heat transfer portion 4, the cold energy of the second low-temperature heat exchanger 22 is transferred to the first low-temperature heat exchanger 12.

Next, an example operation of the thermoacoustic cooling device 10 will be described. In the configuration illustrated in FIG. 1, the heat of the heat source 30 is transferred to the first side 13A of the first stack 13 via the first high-temperature heat exchanger 14. Thus, the first side 13A of the first stack 13 is heated. The first low-temperature heat exchanger 12 transfers the heat between the outside of the tube 3 and the second side 13B of the first stack 13, so as to maintain the temperature of the second side 13B of the first stack 13 at a prescribed first reference temperature (e.g., ambient temperature) or less. Thus, the temperature of the first side 13A of the first stack 13 becomes higher than the temperature of the second side 13B. That is, a temperature gradient (temperature difference) is generated between the first side 13A and the second side 13B of the first stack 13.

When the temperature gradient in the first stack 13 exceeds a critical point, the working fluid inside the first stack 13 vibrates to generate acoustic waves. The vibration of the working fluid inside first stack 13 is transmitted to the working fluid inside the tube 3. That is, the acoustic waves generated in the first stack 13 reach the second stack 23 via the tube 3. Thus, the working fluid in the second stack 23 vibrates. When the working fluid inside the second stack 23 vibrates, a temperature gradient is generated inside the second stack 23. That is, the temperature of the first side 23A of the second stack 23 becomes higher than the temperature of the second side 23B.

The second high-temperature heat exchanger 24 transfers heat between the outside of the tube 3 and the first side 23A of the second stack 23, so as to maintain the temperature of the first side 23A of the second stack 23 at a prescribed second reference temperature (e.g., ambient temperature). Accordingly, when the temperature gradient is generated in the second stack 23, the temperature of the second side 23B of the second stack 23 becomes lower than the second reference temperature. That is, the second side 23B of the second stack 23 is cooled. The second low-temperature heat exchanger 22 transfers cold energy of the second side 23B of the second stack 23 to the cooling target 40 outside the tube 3. Thus, the cooling target 40 is cooled.

Further, the cold energy of the second low-temperature heat exchanger 22 is partially transferred to the first low-temperature heat exchanger 12 via the heat transfer portion 4, and then further transferred to the second side 13B of the first stack 13 from the first low-temperature heat exchanger 12. Accordingly, the temperature of the second side 13B of the first stack 13 decreases. Thus, due to the temperature decrease of the second side 23B of the second stack, both the cooling target 40 and the second side 13B of the first stack 13 are cooled. When the second side 13B of the first stack 13 is cooled via the heat transfer portion 4, the temperature gradient between the first side 13A and the second side 13B of the first stack 13 is increased. Thus, the temperature gradient in the first stack 13 can be made larger without increasing the temperature of the first side 13A of the first stack 13. As a result, it is possible to decrease a required temperature of the heat source 30, that is, a temperature required to operate the thermoacoustic cooling device 10. Further, by increasing the temperature gradient in the first stack 13, it is possible to improve cooling efficiency of the thermoacoustic cooling device 10.

Figure 2:
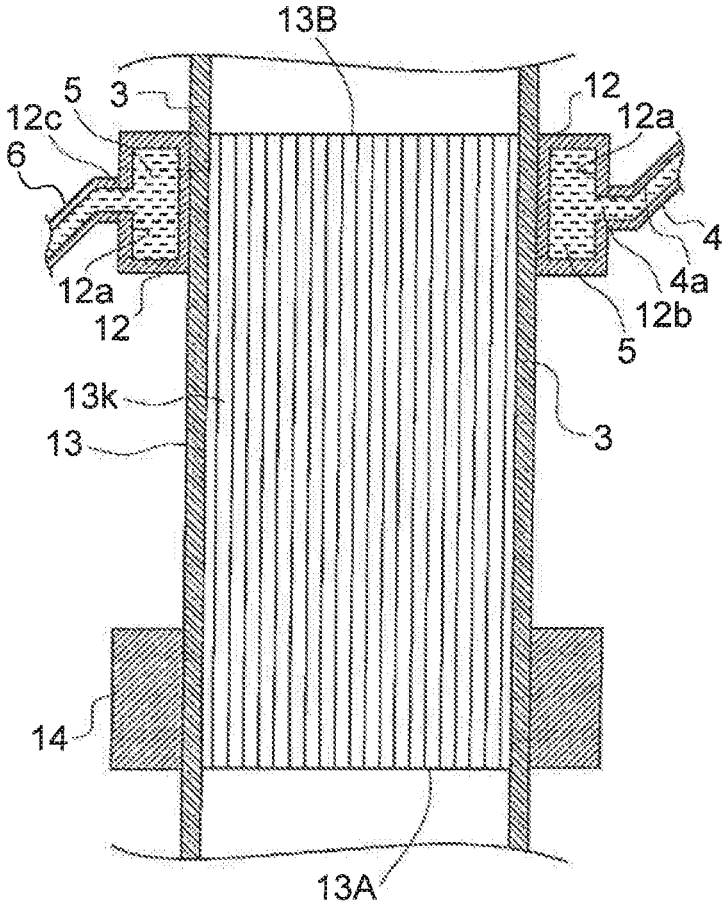
FIG. 2 is a sectional view illustrating an example configuration of a first stack, a first high-temperature heat exchanger, and a first low-temperature heat exchanger illustrated in FIG. 1.

FIG. 2 is a sectional view illustrating an example configuration of the first stack 13, the first high-temperature heat exchanger 14, and the first low-temperature heat exchanger 12 illustrated in FIG. 1. In the example illustrated in FIG. 2, the first high-temperature heat exchanger 14 surrounds the outer peripheral surface of the tube 3 disposed radially outward of the first side 13A of the first stack 13. The first high-temperature heat exchanger 14 may be made of a highly thermally conductive material such as metal.

The first low-temperature heat exchanger 12 surrounds the outer peripheral surface of the tube 3 disposed radially outward of the second side 13B of the first stack 13. The first low-temperature heat exchanger 12 has a passage 12*a* surrounding the outer peripheral surface of the tube 3. A fluid 5 flows through the passage 12*a*. The fluid 5 flows in a circumferential direction of the tube 3. The passage 12*a* has an inlet 12*b* into which the fluid flows, and an outlet 12*c* from which the fluid 5 flows out. The inlet 12*b* is connected to the heat transfer portion 4, for example. The outlet 12*c* is connected to a drain (discharge tube) 6, for example.

In the example illustrated in FIG. 2, the heat transfer portion 4 includes a heat transfer tube 4*a*. The fluid 5 flows between the first low-temperature heat exchanger 12 and the second low-temperature heat exchanger 22 through the heat transfer tube 4*a*. The second low-temperature heat exchanger 22 also has a passage 22*a* surrounding the outer peripheral surface of the tube 3 (see FIG. 3). The heat transfer tube 4*a* connects the passage 12*a* of the first low-temperature heat exchanger 12 to the passage 22*a* of the second low-temperature heat exchanger 22.

The fluid 5 is cooled while passing through the passage 22*a* of the second low-temperature heat exchanger 22. Then, the fluid 5 flows into the passage 12*a* of the first low-temperature heat exchanger 12 through the heat transfer tube 4*a*. The fluid 5 in the passage 12*a* absorbs heat from the first low-temperature heat exchanger 12. The first low-temperature heat exchanger 12 is cooled by the fluid 5 flowing into the passage 12*a*, and thus, the temperature of the second side 13B of the first stack 13 decreases. The fluid 5 that absorbs the heat from the first low-temperature heat exchanger 12 in the passage 12*a* is discharged from the outlet 12*c*.

In an example, the heat transfer tube 4*a* may be configured to cause the fluid 5 to flow from the second low-temperature heat exchanger 22 to the first low-temperature heat exchanger 12. For example, by disposing the second low-temperature heat exchanger 22 at a position higher than the first low-temperature heat exchanger 12, the fluid 5 can flow from the second low-temperature heat exchanger 22 to the first low-temperature heat exchanger 12. Alternatively a pump that causes the fluid 5 to flow from the second low-temperature heat exchanger 22 to the first low-temperature heat exchanger 12 may be provided. Note that the fluid 5 may flow so as to circulate through the second low-temperature heat exchanger 22 and the first low-temperature heat exchanger 12. In this case, the heat transfer portion 4 may include a heat transfer tube through which the fluid 5 flows in a direction from the second low-temperature heat exchanger 22 to the first low-temperature heat exchanger 12, and a heat transfer tube through which the fluid 5 flows in a direction opposite to the above-described direction. That is, the heat transfer portion 4 may include two heat transfer tubes.

Further, although not illustrated in FIG. 2, the passage 12*a* may be provided with another inlet, in addition to the inlet 12*b* connected to the heat transfer tube 4*a*. Thus, a fluid having the first reference temperature can flow into the passage 12*a*, separately from the fluid from the heat transfer portion 4. For example, in addition to the fluid having the first reference temperature, a fluid having a temperature lower than the first reference temperature (e.g., ambient temperature) may be further taken into the passage 12*a* from the heat transfer portion 4. Thus, while the temperature of the second side 13B of the first stack 13 is maintained so as not to become higher than the first reference temperature, the temperature of the second side 13B can be made further lower than the first reference temperature. In this case, while the temperature of the first side 23A of the second stack 23 is maintained at the same temperature as the first reference temperature by the second high-temperature heat exchanger 24, the temperature of the second low-temperature heat exchanger 2.2 at the second side 23B of the second stack 23 can be more reliably made lower than the first reference temperature. Thus, the fluid 5 having a temperature lower than the first reference temperature flows into the first low-temperature heat exchanger 12 via the heat transfer portion 4.

Figure 3:
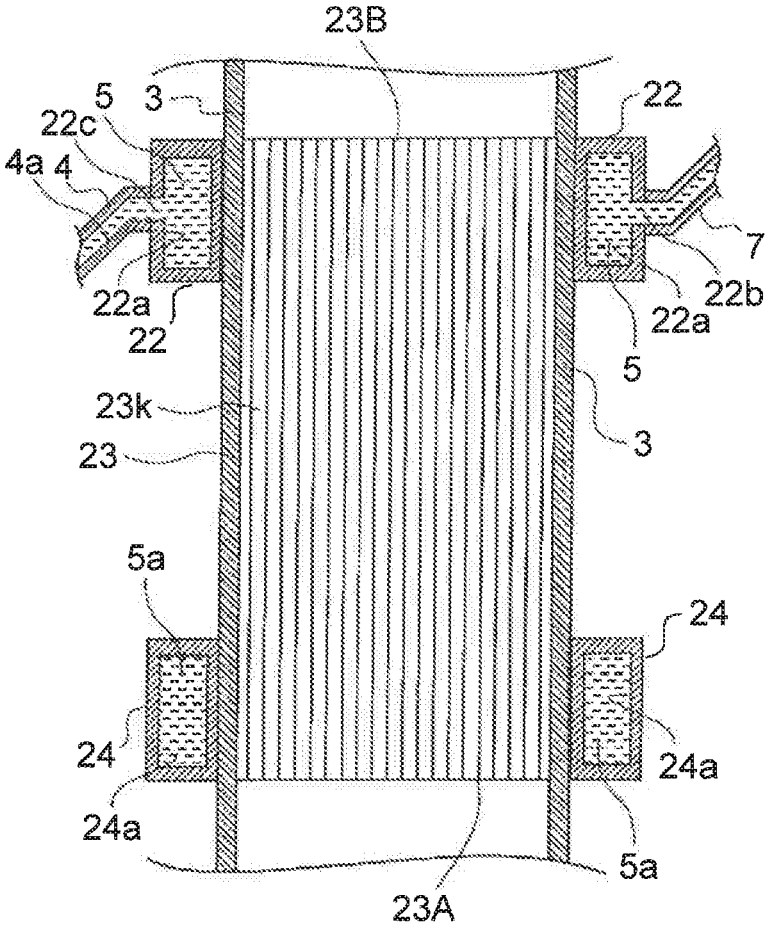
FIG. 3 is a sectional view illustrating an example configuration of a second stack, a second high-temperature heat exchanger, and a second low-temperature heat exchanger illustrated in FIG. 1.

FIG. 3 is a sectional view illustrating an example configuration of the second stack 23, the second high-temperature heat exchanger 24, and the second low-temperature heat exchanger 22 illustrated in FIG. 1. In the example illustrated in FIG. 3, the second high-temperature heat exchanger 24 surrounds the outer peripheral surface of the tube 3 disposed radially outward of the first side 23A of the second stack 23. The second high-temperature heat exchanger 24 has a passage 24*a* surrounding the outer peripheral surface of the tube 3. A fluid 5*a* having the second reference temperature flows through the passage 24*a*. The second reference temperature may be an ambient temperature, for example. Although not illustrated in FIG. 3, the passage 24*a* may he provided with an inlet and an outlet. Thus, the fluid 5*a* can be circulated between a fluid temperature adjusting device (not shown) outside the tube 3 and the passage 24*a*, for example.

The second low-temperature heat exchanger 22 surrounds the outer peripheral surface of the tube 3 disposed radially outward of the second side 23B of the second stack 23. The second low-temperature heat exchanger 22 has a passage 22*a* surrounding the outer peripheral surface of the tube 3. The fluid 5 flows through the passage 22*a*. The fluid 5 flows in the circumferential direction of the tube 3. The passage 22*a* has an inlet 22*b* into which the fluid 5 flows and an outlet 22*c* from which the fluid 5 flows out. The inlet 22*b* is connected to a source of the fluid, such as a faucet. The outlet 22*c* is connected to the heat transfer tube 4*a* of the heat transfer portion 4, for example. Thus, the fluid 5 can flow from the second low-temperature heat exchanger 22 to the first low-temperature heat exchanger 12. In the case where the fluid 5 circulates between the second low-temperature heat exchanger 22 and the first low-temperature heat exchanger 12, the inlet 22*b* may be connected to the outlet 12*c* of the first low-temperature heat exchanger 12 via the heat transfer portion 4.

Each of the fluids 5, 5*a* may be a liquid such as oil, water, or ethylene glycol aqueous solution, or gas, for example.

Figure 4:
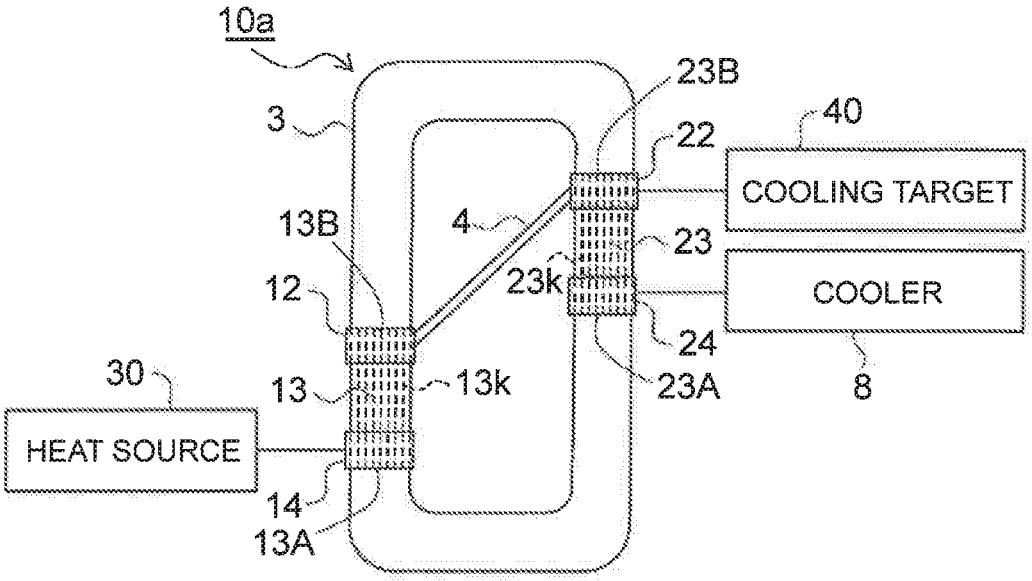
FIG. 4 is a view illustrating a modification of the thermoacoustic cooling device illustrated in FIG. 1.

FIG. 4 is a view illustrating a modification of the thermoacoustic cooling device illustrated in FIG. 1. A thermoacoustic cooling device 10*a* illustrated in FIG. 4 further includes a cooler 8 that cools a second high-temperature heat exchanger 24. When the second high-temperature heat exchanger 24 is cooled by the cooler 8, the temperature of the first side 23A of the second stack 23 is decreased. Accordingly, the temperature of the second side 23B of the second stack 23 also decreases at the time when the temperature gradient is generated in the second stack 23. The second low-temperature heat exchanger 22 at the second side 23B of the second stack 23 is connected to the first low-temperature heat exchanger 12 via the heat transfer portion 4. Accordingly, due to the temperature decrease of the second side 23B of the second stack 23, the temperature of the second side 13B of the first stack 13 also decreases. Thus, the temperature gradient in the first stack 13 can be made large without increasing the temperature of the first high-temperature heat exchanger 14.

In one example, in a case where the second high-temperature heat exchanger 24 is configured as illustrated in FIG. 3, the cooler 8 may be configured to cool the fluid 5*a* flowing through the second high-temperature heat exchanger 24. For example, the fluid 5*a* may be circulated between the second high-temperature heat exchanger 24 and the cooler 8.

In the example illustrated in FIG. 4, the cooler 8 is provided for the second high-temperature heat exchanger 24. In this regard, a cooler may be provided for the first low-temperature heat exchanger 12. For example, the second high-temperature heat exchanger 24 and the first low-temperature heat exchanger 12 may be both provided with coolers. Further, only the first low-temperature heat exchanger 12 may be provided with a cooler. When the first low-temperature heat exchanger 12 is provided with a cooler, it is possible to decrease the temperature of the second side 13B of the first stack 13 and it is also possible to increase the temperature gradient in the first stack 13. For example, when the first low-temperature heat exchanger 12 is cooled at the time of start-up of the thermoacoustic cooling device 10, 10*a*, it is possible to reduce an amount of heat that needs to be supplied to the first high-temperature heat exchanger 14 at the time of start-up. That is, the thermoacoustic cooling device 10, 10*a* can be started up at a low temperature. After the start-up of the thermoacoustic cooling device 10, 10*a*, cold energy is supplied from the second low-temperature heat exchanger 22 to the first low-temperature heat exchanger 12 via the heat transfer portion 4. Accordingly, after the start-up of the thermoacoustic cooling device 10, 10*a*, the cooling of the first low-temperature heat exchanger 12 by the cooler may be stopped.

Figure 5:
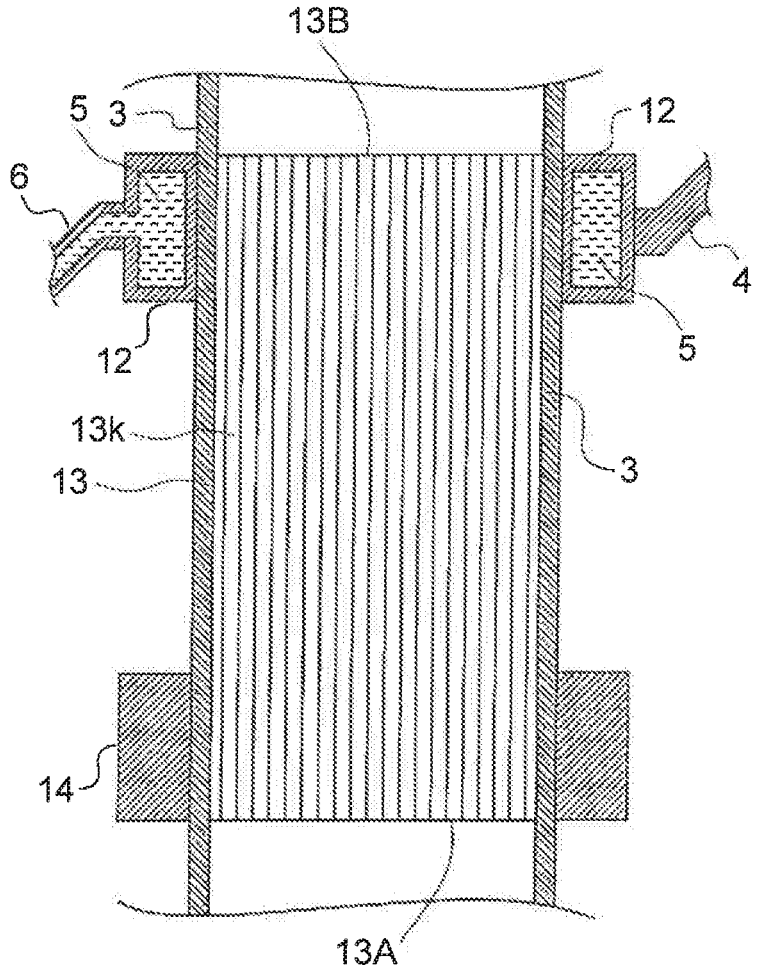
FIG. 5 is a view illustrating a modification of the configuration illustrated in FIG 2.

FIG. 5 is a view illustrating a modification of the configuration illustrated in. FIG. 2. In the example illustrated in FIG. 5, a heat transfer portion 4 includes a metal heat transfer body that connects the first low-temperature heat exchanger 12 to the second low-temperature heat exchanger 22. For example, the heat transfer portion 4 may include a metal bar having one end connected to the first low-temperature heat exchanger 12 and the other end connected to the second low-temperature heat exchanger 22. When the heat transfer portion 4 includes a metal heat transfer body, the configuration of the heat transfer portion 4 can be simplified.

Second Embodiment

Figure 6:
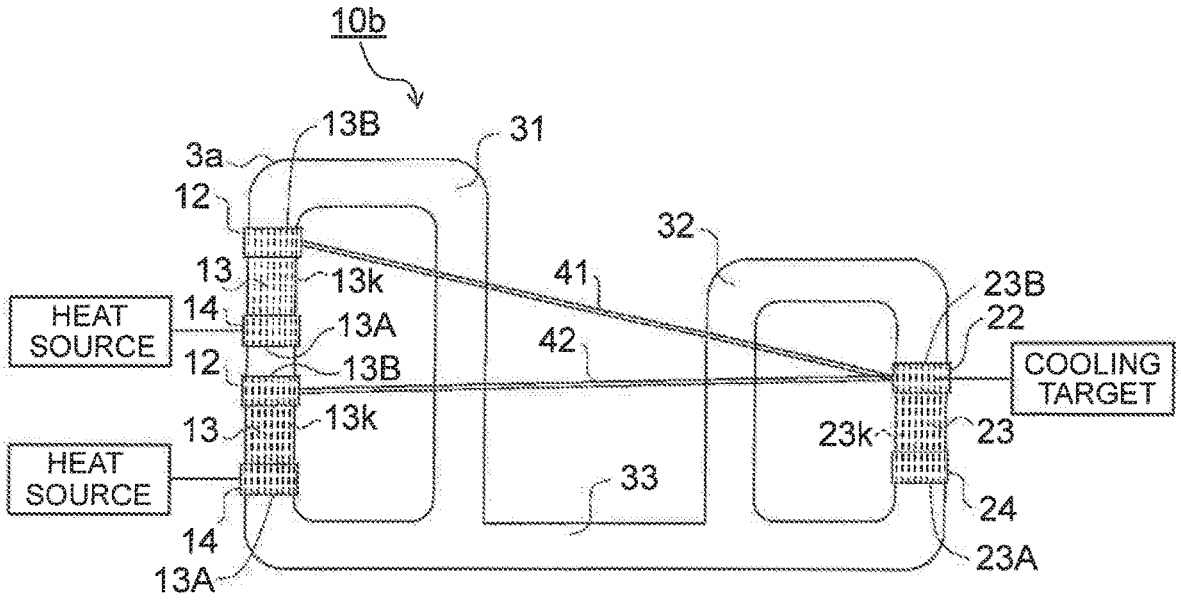
FIG. 6 is a view illustrating an example configuration of a thermoacoustic cooling device in a second embodiment.

FIG. 6 is a view illustrating an example configuration of a thermoacoustic cooling device 10*b* in a second embodiment. The thermoacoustic cooling device 10*b* includes a tube 3*a*, and a plurality of first stacks 13 and a second stack 23 provided inside the tube 3*a*. The tube 3*a* includes two looped tubes 31, 32. A working fluid is enclosed in the tube 3*a*. The two looped tubes 31, 32 are connected to each other via a branch tube 33. The plurality of (two, in this embodiment) first stacks 13 is provided in the looped tube 31. The second stack 23 is provided in the looped tube 32. The first stacks 13 and the second stack 23 may have configurations similar to those in the first embodiment. The number of first stacks 13 is not limited to two, and may be one or three or more.

The second low-temperature heat exchanger 22 at the second side 23B of the second stack 23 and first low-temperature heat exchangers 12 at the second sides 13B of the first stacks 13 are connected to each other such that heat can be transferred between the second low-temperature heat exchanger 22 and the first low-temperature heat exchangers 12 by heat transfer portions 41, 42. Since the heat transfer portions 41, 42 are provided, temperatures of the first low-temperature heat exchangers 12 decrease due to a decrease in the temperature of the second low-temperature heat exchanger 22. Thus, when the thermoacoustic cooling device 10*b* operates, temperatures of the second sides 13B of the first stacks 13 are decreased due to a decrease in the temperature of the second side 23B of the second stack 23. This makes it possible to increase temperature gradients in the first stacks 13.

The embodiments of the disclosure have been described, but the disclosure is not limited to the above embodiments. For example, although each of the heat transfer portions 4, 41, 42 preferably has a linear shape such that a length of a heat transfer path is shortened, the heat transfer portions 4, 41, 42 may be curved. Further, outer peripheral surfaces of the heat transfer portions 4, 41, 42 may be covered with a heat insulation material.

The configurations of the heat exchangers 12, 14, 22, 24 are not limited to the configurations in the above examples. In an example, at least one of the heat exchangers 12, 14, 22, 24 may further include a heat conduction portion including, for example, fins disposed inside the tube 3. In another example, each of the heat exchangers 12, 14, 22, 24 may further include a heat conduction portion having a plurality of conduction paths extending in the lengthwise direction of the tube 3, and the beat conduction portions may be disposed on the sides of the stacks 13, 23 in the tube 3. In this case, the first stack 13 is sandwiched between the heat conduction portions of the first high-temperature heat exchanger 14 and the first low-temperature heat exchanger 12 inside the tube 3. The second stack 23 is sandwiched between the heat conduction portions of the second high-temperature heat exchanger 24 and the second low-temperature heat exchanger 22 inside the tube 3. When each of the heat exchangers 12, 14, 22, 24 further includes the heat conduction portion thus disposed inside the tube 3, temperatures of the both ends of the stacks 13, 23 can be adjusted to desired temperatures more efficiently. That is, it is possible to further improve the efficiency of heat exchange in the stacks 13, 23.

The configurations of the stacks 13, 23 are not limited to the configurations in the above examples. For example, in the first stack 13 and the second stack 23, the conduction paths 13*k*, 23*k* extending in the lengthwise direction of the tube 3 may be curved.

What is claimed is:

1. A thermoacoustic cooling device comprising:

a tube including at least one looped tube, and a working fluid being enclosed within the tube;

a first stack provided inside the tube, the first stack being configured to generate acoustic waves in the working fluid in the tube using a temperature gradient in the first stack;

a first high-temperature heat exchanger provided at a first side of the first stack, the first high-temperature heat exchanger being configured to heat the first side of the first stack using heat from an outside of the tube;

a first low-temperature heat exchanger provided at a second side of the first stack, the first low-temperature heat exchanger being configured to cause a temperature of the second side of the first stack to be lower than a temperature of the first side of the first stack;

a second stack provided inside the tube, the second stack being configured to generate a temperature gradient of the second stack by the acoustic waves of the working fluid in the tube;

a second high-temperature heat exchanger provided at a first side of the second stack;

a second low-temperature heat exchanger provided at a second side of the second stack, the first side of the second stack having a higher temperature at a time when the temperature gradient is generated in the second stack than a lower temperature of the second side of the second stack at the time when the temperature gradient is generated in the second stack; and a heat transfer device connecting the second low-temperature heat exchanger to the first low-temperature heat exchanger, the heat transfer device being configured to transfer heat between the second low-temperature heat exchanger and the first low-temperature heat exchanger.

2. The thermoacoustic cooling device according to claim 1, wherein the heat transfer device includes a heat transfer tube through which a fluid flows between the second low-temperature heat exchanger and the first low-temperature heat exchanger.

3. The thermoacoustic cooling device according to claim 2, wherein the heat transfer tube is configured to cause the fluid to flow from the second low-temperature heat exchanger to the first low-temperature heat exchanger.

4. The thermoacoustic cooling device according to claim 1, wherein the heat transfer device includes a metal heat transfer body that connects the second low-temperature heat exchanger to the first low-temperature heat exchanger.

5. The thermoacoustic cooling device according to claim 1, further comprising a cooler configured to cool the second high-temperature heat exchanger.

6. The thermoacoustic cooling device according to claim 1, wherein:

the first high-temperature heat exchanger is disposed on an outer peripheral surface of the tube at a position corresponding to the first side of the first stack;

the first low-temperature heat exchanger is disposed on the outer peripheral surface of the tube at a position corresponding to the second side of the first stack;

the second high-temperature heat exchanger is disposed on the outer peripheral surface of the tube at a position corresponding to the first side of the second stack; and the second low-temperature heat exchanger is disposed on the outer peripheral surface of the tube at a position corresponding to the second side of the second stack.

* * * * *